United States Patent [19]

Sohler

[11] 4,372,638

[45] Feb. 8, 1983

[54] ELECTRICAL CONNECTOR FOR TAPPING INTO A FUSE BLOCK

[76] Inventor: Lawrence J. Sohler, 15848 Moorpark St., Encino, Calif. 91436

[21] Appl. No.: 233,977

[22] Filed: Feb. 12, 1981

[51] Int. Cl.[3] ..... H01H 85/46; H01R 11/00; H01R 13/115

[52] U.S. Cl. ..... 339/273 F; 339/147 R; 339/242; 339/258 F; 337/251

[58] Field of Search ..... 339/147 R, 253 F, 256 C, 339/258 R, 258 F, 259 F, 262 F, 166 R, 273 R, 273 F, 242; 337/214, 215, 251-254

[56] References Cited

U.S. PATENT DOCUMENTS 2,443,797 6/1948 Miller ..... 339/166 R 3,274,533 9/1966 Apted et al. ..... 339/166 R 3,821,695 6/1974 Sohler ..... 339/258 F

*Primary Examiner*—Neil Abrams

*Attorney, Agent, or Firm*—Allan D. Mockabee

[57] ABSTRACT

An electrical connector for vehicle fuse blocks having recesses with fuse blade connectors to removably receive blades of fuses lying in the upper portions and above said recesses wherein the electrical connector comprises a strip of conductive metal bent upon itself to provide an upstanding connector tab above the fuse elements with spaced parallel legs extending downwardly at each side of the fuse element and into a fuse block recess to be frictionally held between one of the spring contact elements and a wall of the recess.

7 Claims, 4 Drawing Figures

ELECTRICAL CONNECTOR FOR TAPPING INTO A FUSE BLOCK

FIELD OF THE INVENTION

The invention is in the field of electrical connectors for accessories such as radios and tape decks wherein such accessories can be quickly and efficiently connected into the electrical systems of the vehicle at the factory installed fuse block assembly.

PRIOR ART

The closest known prior art is the following U.S. Pat. Nos.:

3821695: Sohler, June 29,1974;
3516047: Young, June 2, 1970;
2343677: LaMar, Mar. 7,1944;
1930428: Jackson, Oct. 10, 1933;
1916711: Allgeier, July 4, 1933.

The present invention and that of my prior U.S. Pat. No. 3821695, listed above, are directed to connectors for quickly and easily connecting additional circuits into preexisting electrical circuits of land or water motor vehicles. Such additional circuits are required when installing electrical accessories such as radios and tape decks after the vehicle has left the factory. In my prior patent identified above, the fuse blocks of most motor vehicles contained spaced pairs of conductive spring clips between which the end of cylindrical cartridge fuses were inserted. My prior patent provided a construction whereby the accessory circuit could be connected in through a novel and efficient interconnection of the end of a new accessory conductor with upwardly and outwardly divergent arms of a spring clip for holding an end of a cartridge fuse. The other prior patents identified above were for various types of connectors. The connector of my prior patent, however, while of a quite different structure and operation is closer to the structure of the present invention than any of the other prior art listed.

A great many of the currently produced motor vehicles and particularly automobiles, do not have the formerly used cylindrical cartridge fuses. They are presently fuses whose elements are embedded in plastic wafers, each wafer having a pair of contact blades extending therefrom. The contact blades and the lower portions of the wafers are received in recesses in a fuse block with the blades received frictionally between pairs of relatively narrow pairs of spring contacts, said contacts being spaced closely adjacent opposite walls of the recess in the block. There was no way in which the connector of my prior patent could be utilized with current fuse and fuse block constructions. The former type of connector could not straddle an upwardly disposed fuse body and extend downwardly therebelow to fit with a wedge like action between the outwardly disposed surface of a spring contact arm and an adjacent wall of the recess in the fuse block of the present type.

The present invention provides a construction with which quick and dependable connection can be made with the present fuse and fuse block construction and it is economical to manufacture and install.

The objects of the invention will more fully appear from the following description in connection with the accompanying drawing.

Figure 1:
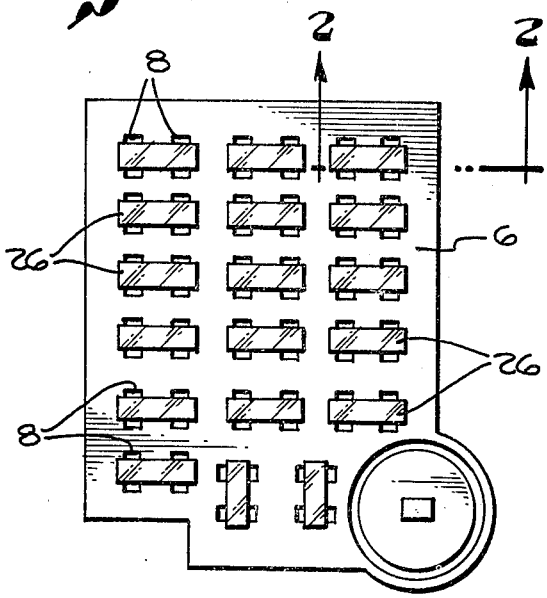
FIG. 1 is a plan view of a current type of fuse block construction and arrangement.

There is illustrated a fuse block 6 having a plurality of recesses 8 having pairs of lower portions 10 and a larger upper portion 12. As viewed in FIG. 3, the upper portion 12 joins the lower portions 10 at slanted walls 14. Also as viewed in FIG. 3 there are spaced parallel side walls 16 which are spaced a little further than the lower side wall portions 18 to provide a pair of shoulders 20.

Figure 2:
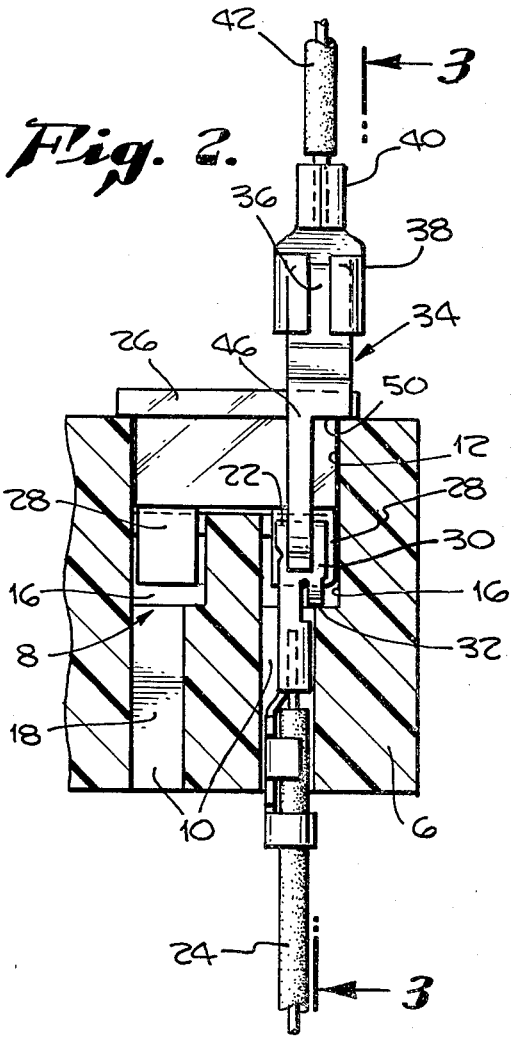
FIG. 2 is an enlarged sectional detail taken approximately on the line 2—2 of FIG. 1.

Each of the recess portions 10 is adapted to receive upwardly therethrough a pair of fuse blade contact elements 22 which lie rather closely adjacent the recess side wall portions 16. The contact elements 22 are suitably secured to a conductor 24 which forms part of an electrical circuit in a motor vehicle. Referring to FIG. 2, the empty left recess portion 10 is adapted to receive a pair of fuse blade contact elements 22 in the same manner as is shown in the right hand recess portion 10.

Received in the enlarged upper portion 12 of the recess 8 is a fuse body 26 having a pair of contact blades 28 secured in and extending downwardly therefrom. Each blade 28 is frictionally gripped between downwardly turned portions 30 of the fuse blade contact elements 22. The fuse body 26 is inserted and removed by pressing the blade 28 downwardly between the contact elements 22 or pulling them upwardly from between them.

When the contact elements 22 and the upper end of a conductor 24 are inserted upwardly into the fuse block cavity, retaining lugs 32, struck from portions of the contact elements 22, snap past their respective shoulders 20 so that the contact elements 22 and conductor 24 cannot be displaced downwardly in the fuse block cavity 8.

Figure 4:
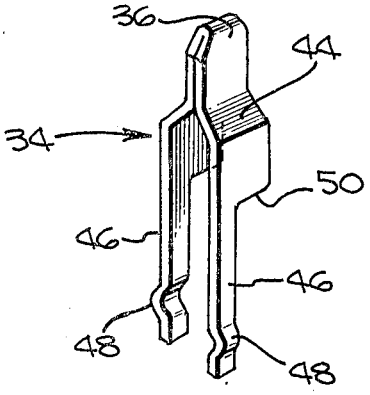
FIG. 4 is a prospective view of one of the connectors per se.

FIG. 4 illustrates one of the connector elements of the invention, generally indicated at 34. It comprises an elongated strip of conductive metal bent upon itself between its ends to provide an upstanding tab 36 to receive a conventional slip-on connector 38, a portion 40 of which is secured to the end of an electrical conductor 42 which forms part of a circuit to an automobile radio or other accessory installed in the vehicle after it leaves the factory. The connector 34, which is termed a "clip", to differentiate it from the other connectors illustrated and mentioned, has portions below the tab 36 bent outwardly away from each other as at 44 and then elongated downwardly extending portions 46 which are in parallel spaced relation to each other. The lower ends of the lower portions 46 are provided with crimps 48, and the medial and lower portions of the parallel legs 46 are narrower than the upper portion of the strip to provide a shoulder 50.

The connector clip 34 is inserted in one of the fuse block cavities 8 so that it will enter the wider upper portion 12 of said cavity at either side of the fuse body 26, whereupon it will engage the slanted surfaces 14 of the cavity and become wedged between the respective connector elements 22 and the opposed recess walls 16 to provide a good frictional electrical contact with the contact elements 22. The crimps 48 at the lower ends of the connector clip portions 46 provide the close wedge fit necessary to make a good contact.

The connector clip 34 is prevented from being pushed too far into the fuse block cavity 8 by reason of the shoulder 50 at each side of the clip which engages the upper surface of the fuse block 6. This prevents the lower ends of the connector clip legs 46 from displacing the retaining lugs 32 which hold the connector elements 22 in place.

Figure 3:
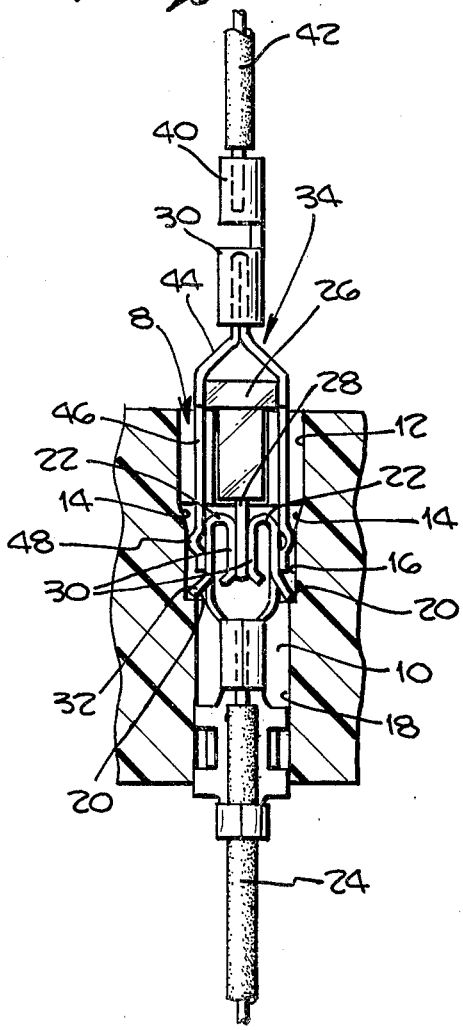
FIG. 3 is a section taken approximately on the line 3—3 of FIG. 2.

The connector clip 34 is then in a position shown in FIGS. 2 and 3 and the connector element 38 on the conductor 42 can then be slipped over the upwardly disposed connector clip tab 36 with a frictional gripping action to keep it in place and maintain good elecrical contact.

It will be seen that the simple connector clip element 34 provides economical and quick attachment means for adding a circuit to the fuse block assembly of a motor vehicle without requiring the installer to resort to splicing wires, making soldered connections or other more difficult and time consuming expedients. Its tab 36 provides quick and easy interconnection with conventional connector elements such as 38.

It should be understood that changes can be made in the form, proportions and details of the device without departing from the spirit of the invention.

I claim:

1. An elecrical connector for use with a fuse block having a recess defined by spaced opposed side walls, a pair of fuse blade contact elements in said recess adjacent said side walls and a fuse body in the upper portion of said recess above said pair of fuse contacts, said fuse body having a contact blade depending therefrom and removably received between said fuse blade contact elements, comprising:

an electrically conductive clip having an upper portion adapted to connect with an electrical connector, a pair of legs extending downwardly from saidupper portion and having inner faces comprising elecrical contact surfaces, said legs being spaced and of a length to straddle said fuse body and said spring contact elements, and said legs having at least portions thereof with sufficient lateral dimension to wedge between their respective spring contact elements and the side walls of said recess, causing the legs to grip said fuse blade contact elements and biasing the fuse blade elements to grip the fuse blade.

2. The structure in claim 1, and said clip having a lateral projection engageable with said fuse block to limit movement of said legs into said fuse block recess.

3. The structure in claim 1, and said upper portion of said clip being of a height to lie above said fuse body to accommodate connection with an electrical conductor.

4. The structure in claim 3, and said upper portion of said clip comprising an upstanding rigid tongue.

5. The structure in claim 1, and said clip comprising an elongated strip of metal bent upon itself at its longitudinal medial portion to provide an upstanding connector tab, adjacent portions of said strip being bent laterally outwardly away from each other, thence downwardly parallel to each other.

6. The structure in claim 5, and said downwardly bent parallel portions of said clip each having a crimp therein to provide a wedge between its respective fuse blade contact element and an adjacent opposed recessed side wall.

7. The structure in claim 1, and said downwardly bent parallel portions of said clip each having a crimp therein to provide a wedge between its respective fuse blade contact element and an adjacent opposed recess side wall.

* * * * *